United States Patent [19]

Fafournoux

[11] Patent Number: 4,765,125

[45] Date of Patent: Aug. 23, 1988

[54] FLEXIBLE PACK POSSESSING AN EVACUATION MEANS AND DEVICE FOR THE EVACUATION OF THIS PACK

[76] Inventor: Bernard Fafournoux, Le Roumingue, 33138 Lanton, France

[21] Appl. No.: 88,294

[22] Filed: Aug. 24, 1987

[30] Foreign Application Priority Data

Aug. 26, 1986 [FR] France ..... 86 12070

[51] Int. Cl.[4] ..... B65B 31/00

[52] U.S. Cl. ..... 53/512; 53/390; 53/373; 53/434

[58] Field of Search ..... 53/79, 373, 390, 434, 53/512

[56] References Cited

U.S. PATENT DOCUMENTS 3,516,223 6/1970 Anderson ..... 53/212
4,295,566 10/1981 Vincek ..... 206/457
4,330,975 5/1982 Kakiuchi ..... 53/212 X
4,418,514 12/1983 Spann ..... 53/434

FOREIGN PATENT DOCUMENTS 1869335 11/1963 Fed. Rep. of Germany .
951228 3/1964 United Kingdom ..... 53/434

*Primary Examiner*—John Sipos
*Attorney, Agent, or Firm*—Gerald J. Ferguson, Jr.

[57] ABSTRACT

The pack according to the invention possesses an edge 4 delimiting an orifice and an evacuation means comprising an elastically compressible volume 5 having a wall, which possesses means for the passage of air 8, and arranged inside the pack near the edge 4 of the pack, but at a distance from this. The invention also relates to a device allowing the alternate compression and expansion of the compressible volume, whilst at the same time ensuring alternate communication between the latter and the inside of the bag or the outside.

3 Claims, 2 Drawing Sheets

FLEXIBLE PACK POSSESSING AN EVACUATION MEANS AND DEVICE FOR THE EVACUATION OF THIS PACK

The present invention relates to a flexible pack possessing an evacuation means and to a device for the evacuation of such a pack.

Flexible packs possessing an evacuation means are already known. In particular, the French patent published under No. 2,539,709 describes a pack with a flexible wall and with sealed closure, containing an auxiliary pocket limiting a volume which is empty of air before use, this pocket being equipped with a means of putting it in communication with the pack when the latter has been sealed closed. Thus, when the auxiliary pocket is put in communication with the bag, it extracts some of the air contained in the pack and thus generates a partial vacuum which improves the preservation of the products contained in the pack. However, it is found that, in this type of pack, the auxiliary pocket can only execute a single pumping of the air contained in the pack, and it is therefore necessary to provide an auxiliary pocket, the dimensions of which are in proportion to the amount of vacuum which is to be obtained in the pack. Such a constraint is often incompatible with the dimensions which the pack is to have.

An object of the present invention is to provide a pack possessing an evacuation means which can execute several pumping operations, and a device for the evacuation of this pack.

To achieve this object, according to the invention there is provided a flexible pack with a sealed wall possessing an edge delimiting an orifice and an evacuation means and in which the evacuation means comprises an elastically compressible volume having a wall, which possesses means for the passage of air, and arranged inside the pack near the edge of the pack, but at a distance from this.

Thus, the compressible volume is used to execute several pumping cycles, in each pumping cycle obtaining a compression of the compressible volume, whilst at the same time isolating the latter from the interior of the pack, and then a relaxation of the compressible volume, whilst at the same time closing the orifice in the pack in a sealed manner and at the same time putting the interior of the pack in communication with the compressible volume.

According to a preferred embodiment of the invention, the compressible volume is formed by a strip of flexible material fastened to the wall of the pack inside the latter and surrounding an elastic member, preferably a block of open-cell foam. The compressible volume is thus retained permanently at a desired location.

According to another feature of the invention, there is a device for the evacuation of the pack according to the invention, this device comprising a base for receiving one end of the flexible pack adjacent to the orifice and containing the compressible volume, a first movable bearing member, to which is fastened a first sealing means extending transversely relative to the base on a side of the compressible volume opposite the orifice in the pack, this first bearing member having a bearing surface arranged so as to come up against the compressible volume when the first bearing member is moved towards the pack, this bearing surface being set back relative to the first sealing means, and a second movable bearing member, to which is fastened a second sealing means extending transversely relative to the base on a side of the compressible volume facing the orifice in the pack. Thus, an alternate laying of the first bearing member and of the second bearing member against the base of the device produces the pumping cycles described above.

According to an advantageous version of this feature of the invention, the device possesses means for the sealed closure of the pack. Thus, when the desired pumping has been carried out, the pack is closed in a sealed manner and remains under a vacuum.

According to yet another advantageous feature of the invention, the means for sealed closure extend parallel to the second sealing means between the second sealing means and the edge of the pack. Thus, the second sealing means keeps the walls of the pack close up against one another during closing, so that a high-quality closure is obtained easily.

Other characteristics and advantages of the invention will also emerge from a reading of the following description of a particular non-limiting embodiment, in conjunction with the attached drawings in which.

Figure 1:
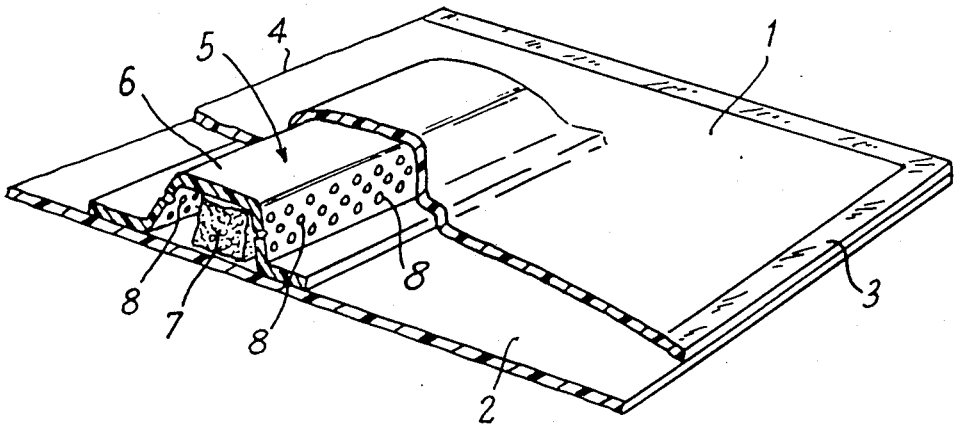
FIG. 1 is a sectional perspective view of an embodiment of the pack according to the invention.

Referring to FIG. 1, the flexible pack according to the invention comprises a sealed wall produced, for example, from heat-sealable plastic films 1 and 2 joined to one another on three sides by means of a weld 3, so that the fourth side forms an edge 4 delimiting an orifice in the pack. According to the invention, this pack has an elastically compressible volume, designated as a whole by 5, formed by a strip of flexible material 6, for example a strip of heat-sealable plastic, fastened to the wall 2 of the pack inside the latter and surrounding an elastic member 7 consisting of a block of open-cell foam. The compressible volume 5 possesses means for the passage of air which are formed by holes 8 made on two opposite sides of the volume 5, one series of holes 8 being directed towards the orifice in the pack and the other series of holes 8 facing the bottom of the pack. It will be seen in FIG. 1 that the compressible volume 5 extends near the edge 4 of the pack, whilst being at a distance from this. The pack thus has a strip which is located between the compressible volume 5 and the edge 4 of the pack and along which the films 1 and 2 can be laid against one another.

Figure 2:
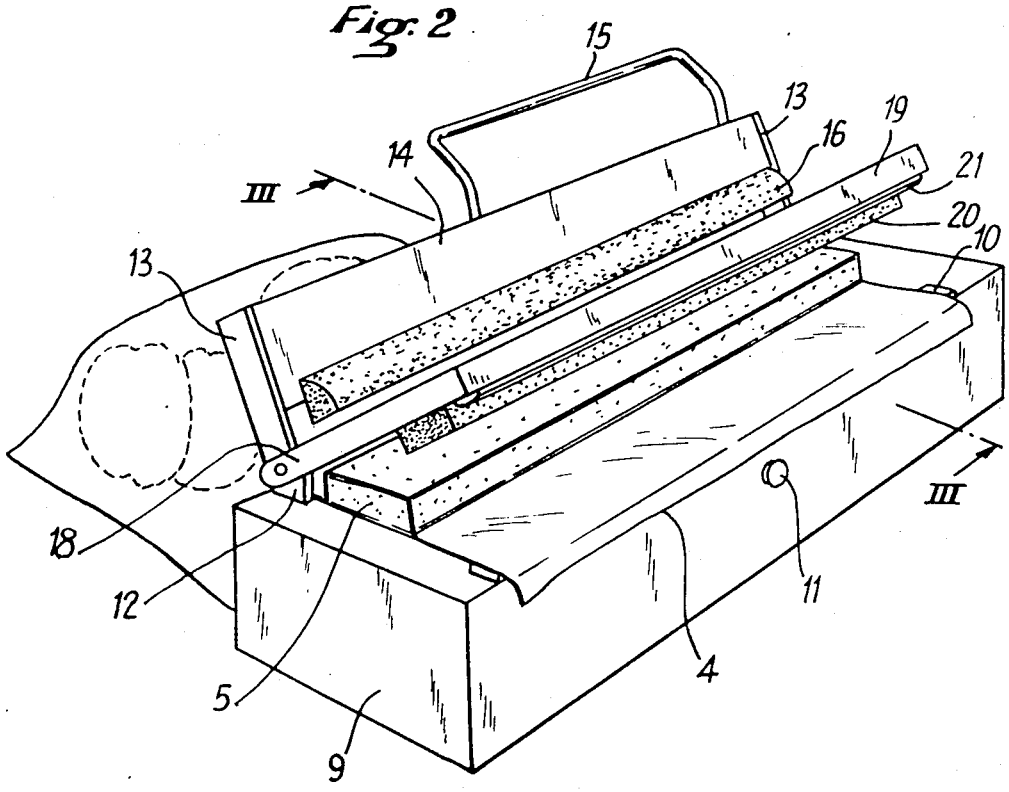
FIG. 2 is a perspective view of the evacuation device according to the invention.

Referring to FIG. 2, the device for the evacuation of the pack according to the invention has a base 9, for example a parallelepipedic box, on which the part of the flexible pack containing the compressible volume 5 can be arranged. The base has means for the sealed closure of the pack, and, for example, where a heat-sealable pack is concerned, the means for sealed closure are formed by a heating resistor 10 which is carried by the upper face of the base 9 and the electricity supply of which is controlled by a switch 11 likewise carried by the base.

On a side opposite the heating resistor 10, the base has vertical lugs 12, on which is articulated a first bearing member comprising arms 13 mounted pivotally on the lugs 12 and connected to one another by means of a bearing plate 14. A handle 15 is fastened to the bearing plate 14. A first sealing means 16, for example a foam strip, is fastened to the bearing plate 14 and extends transversely relative to the base on a side of the compressible volume opposite the orifice in the pack. The bearing plate 14 forming the first bearing member has a bearing surface 17 arranged so as to come up against the compressible volume 5 when the first bearing member is moved towards the pack. The bearing surface 17 is set back relative to the first sealing means 16. A second bearing member is likewise mounted pivotally on the vertical lugs 12. This second bearing member comprises arms 18 connected by means of a plate 19. The plate 19, on its lower face, carries a second sealing means 20 extending transversely relative to the base on a side of the compressible volume 5 facing the orifice in the pack. The plate 19 likewise carries a strip of flexible material 21 which keeps the end of the pack laid against the heating resistor 10 when the second bearing member is held against the pack.

Figure 3:
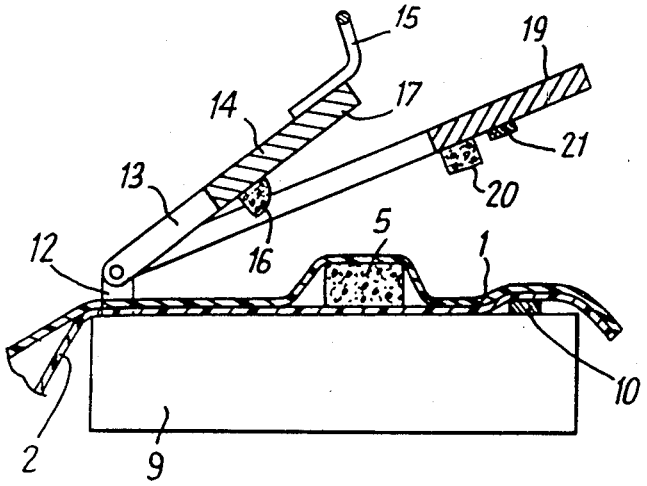
FIG. 3 is a diagrammatic sectional view, along the line III—III of FIG. 2, of the device according to the invention in a first position.
Figure 4:
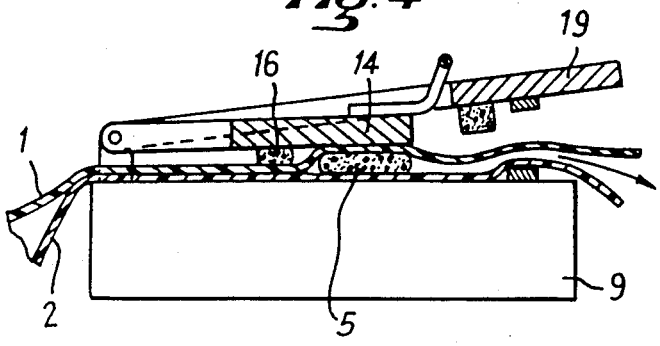
FIG. 4 is a sectional view, identical to FIG. 3, relating to a second position of the device.
Figure 5:
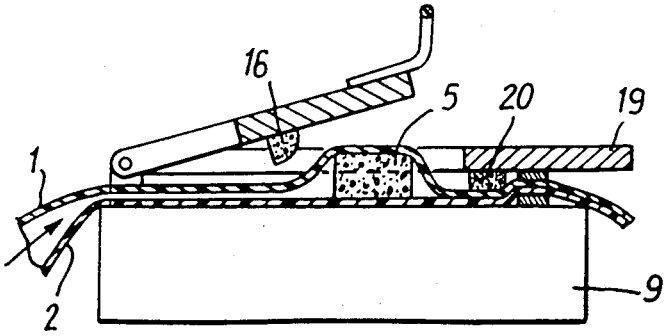
FIG. 5 is a sectional view, identical to that of FIG. 3, relating to a third position of the device.

The device according to the invention operates as follows:

The first and second bearing members being raised, the end of a pack containing products is arranged on the base 9, as shown in FIG. 3, that is to say with the compressible volume 5 located at a distance from the pivot axis of the first and second bearing members which is between the distance of the first sealing means 16 and that of the second sealing means 20 in relation to this same pivot axis. The handle 15 is then lowered, and during this movement the first sealing means 16 first comes in contact with the pack and lays the films 1 and 2 against one another, so that it ensures sealing between the part of the pack containing the products and the compressible volume 5. When the movement of the handle 15 towards the base 9 is continued, the bearing surface 17 of the bearing plate 14 compresses the compressible volume 5 and air escapes from the pack, as shown in FIG. 4. The second bearing member is then lowered, so that the second sealing means 20 keeps the films laid against one another on the opposite side to the first sealing means 16 in relation to the compressible volume 5. The first bearing member is subsequently raised and the compressible volume 5 resumes its initial shape, at the same time sucking air from the part of the bag containing the products, as shown in FIG. 5. It can therefore be seen that, if the first bearing member and the second bearing member are actuated alternately, the air included in the part of the pack containing the products is progressively pumped, up to the moment when the desired amount of vacuum has been obtained. With the second bearing member still held against the base 9, the switch 11 is then actuated in order to heat the resistor 10 and thus ensure the sealed closure of the pack.

Of course, the invention is not limited to the embodiment described, and it can have alternative forms. In particular, the compressible volume 5 is not necessarily fastened permanently in the pack and can be produced in the form of a simple block of open-cell foam fitted at the moment when the pack is closed, so that it can be recovered when the pack is reopened. Likewise, although the device has been shown with bearing members mounted pivotally, there can be a device having columns, on which the bearing members are mounted slidably.

Furthermore, connecting means, for example links or cams, can be provided between the first and second bearing members, to ensure that the two bearing members are brought to bear alternately; moreover, at least one of the bearing members can be returned to a particular position by means of a restoring spring or an equivalent means.

Also, the welding device can be located on a side of the second sealing means opposite the edge of the pack. In this case, the compressible volume 5 can be recovered immediately after welding, so that it can be used at once in a new pack.

I claim:

1. A device for evacuating flexible packs each comprising wall means defining a pocket having an orifice, an elastically compressible chamber located inside said pocket adjacent to, but spaced from, said orifice, and means defining a passage for fluid between said chamber and said pocket, the device comprising a base defining a predetermined position on to which the compressible chamber is to be located when a pack is positioned on said base, a first carrier movable towards and away from said base, first sealing means mounted on the first carrier and positioned to engage said base on one side of said predetermined position when the first carrier is moved towards the base, a compression member mounted on the first carrier and positioned to engage the base in said predetermined position when the first carrier is moved towards said base for compressing said chamber at said predetermined position, a second carrier movable towards and away from the base, and second sealing means mounted on said second carrier and positioned to engage said base on the opposite side of said predetermined position when the second carrier is moved towards said base.

2. A device according to claim 1, comprises heat sealing means mounted on the base for effecting a heat seal closure to the pack.

3. A device according to claim 2, wherein the heat sealing means is mounted on the base between the position at which the second sealing means is adapted to engage the base and the edge of the base.

* * * * *